US010301080B2

(12) United States Patent
Lotfi

(10) Patent No.: US 10,301,080 B2
(45) Date of Patent: May 28, 2019

(54) TAMPER PROMINENT CONTAINERS

(71) Applicant: Ali Lotfi, Weston, MA (US)

(72) Inventor: Ali Lotfi, Weston, MA (US)

( * ) Notice: Subject to any disclaimer, the term of this patent is extended or adjusted under 35 U.S.C. 154(b) by 0 days.

(21) Appl. No.: 15/472,259

(22) Filed: Mar. 28, 2017

(65) Prior Publication Data

US 2017/0275059 A1 Sep. 28, 2017

Related U.S. Application Data

(60) Provisional application No. 62/314,385, filed on Mar. 28, 2016.

(51) Int. Cl.

| | |
|---|---|
| ***B65D 43/02*** | (2006.01) |
| ***B65D 1/42*** | (2006.01) |
| ***B65D 51/24*** | (2006.01) |
| ***B65D 21/02*** | (2006.01) |

(52) U.S. Cl.

CPC ..... *B65D 43/0249* (2013.01); *B65D 1/42* (2013.01); *B65D 21/0219* (2013.01); *B65D 43/0254* (2013.01); *B65D 51/245* (2013.01); *B65D 2101/0092* (2013.01); *B65D 2543/0049* (2013.01); *B65D 2543/0074* (2013.01); *B65D 2543/00083* (2013.01); *B65D 2543/00101* (2013.01); *B65D 2543/00111* (2013.01); *B65D 2543/00203* (2013.01); *B65D 2543/00296* (2013.01); *B65D 2543/00509* (2013.01); *B65D 2543/00537* (2013.01); *B65D 2543/00555* (2013.01); *B65D 2543/00611* (2013.01); *B65D 2543/00657* (2013.01); *B65D 2543/00666* (2013.01); *B65D 2543/00685* (2013.01); *B65D 2543/00722* (2013.01); *B65D 2543/00759* (2013.01); *B65D 2543/00796* (2013.01); *B65D 2543/00842* (2013.01)

(58) Field of Classification Search

CPC .... B65D 43/0249; B65D 1/42; B65D 51/245; B65D 43/0254; B65D 21/0219; B65D 43/0237; B65D 2101/0092

USPC ..... 206/459.1; 220/833, 266, 270

See application file for complete search history.

(56) References Cited

U.S. PATENT DOCUMENTS

| | | | | |
|---|---|---|---|---|
| 3,631,617 | A * | 1/1972 | Pekko | G09F 3/0292 283/101 |
| 5,788,105 | A * | 8/1998 | Foos | B65D 43/162 206/1.5 |
| 2005/0017007 | A1 | 1/2005 | Sellari et al. | |

(Continued)

*Primary Examiner* — Steven A. Reynolds

(74) *Attorney, Agent, or Firm* — JWIP & Patent Services, LLC; Jacob G. Weintraub, Esq.

(57) ABSTRACT

The present invention is directed to containers and packaging that incorporate novel tamper evident features that make prominent the evidence of tamper. In particular, the novel tamper prominent containers of the present invention comprise newly designed tamper prominent images, i.e., prominent continuity control (PCC) images. Additionally, the present invention provides novel methods of increasing prominence of the evidence of tamper with a container, e.g., of consumer goods, by incorporating prominent continuity control (PCC) images integrated with a button locking assembly that must be removed to open a locked container making prominent the evidence of tamper through clear visualization in the PCC image, e.g., prominently displaying an image of a broken lock after full fracture and removal of the button locking assembly.

20 Claims, 5 Drawing Sheets

(56) References Cited

U.S. PATENT DOCUMENTS

| | | | | |
|---|---|---|---|---|
| 2006/0255054 | A1* | 11/2006 | Vovan | B65D 55/026 220/793 |
| 2007/0045317 | A1* | 3/2007 | Rosender | B65D 43/0249 220/266 |
| 2009/0321463 | A1 | 12/2009 | Vovan | |
| 2010/0224630 | A1 | 9/2010 | Petlak et al. | |
| 2012/0292322 | A1 | 11/2012 | Meyer et al. | |
| 2013/0068654 | A1 | 3/2013 | MacDonald | |
| 2014/0367383 | A1* | 12/2014 | Sellari | B65D 43/0254 220/270 |
| 2015/0344180 | A1* | 12/2015 | Shakoori Divani | B65D 21/086 206/459.1 |

* cited by examiner

TAMPER PROMINENT CONTAINERS

RELATED APPLICATIONS

This application claims priority to U.S. Provisional Patent Application No. 62/314,385, filed on Mar. 28, 2016; the entirety of which is incorporated herein by reference.

BACKGROUND OF THE INVENTION

Consumers of products that are stored in their containers for repeated access generally prefer reclosable packages, particularly for comestible products, in order to reduce deterioration of the product. Moreover, disposable containers have become increasingly prevalent in today's commercial atmosphere to satisfy this demand. However, in certain product lines, evidence of product integrity for both merchants and their customers is critical for confidence in the product quality.

Such assurance of integrity, quality, and lack of tampering has been addressed in the past using a number of different "break-away" approaches where components that are broken to open the package cannot be reattached; such as through total package wrapping, partial package wrapping (e.g., plastic wrap around the edge of the cover), or through varying sizes of seals, tapes, or labels that may be broken to access the packaged goods. Recent advances in plastic thermoform technology have afforded access to packages that contain tear lines and tear strips created by scoring or perforating the plastic, which have provided increased ability for convenient visual inspection of packages of goods that are intended to be tamper evident.

As consumers generally gravitate towards packages that are easier to visually inspect for tampering prior to purchase, tear strips have been favored over tear lines for the fact that a tangible thin strip must be removed before the package can be opened; and thus the presence of an attached tear strip easily confirms the integrity of a product. Limitations of these products, however, relate to their hinged design, wherein the hinge of the cover with the base in each of these designs falls on a perforation that is by design, structurally weakened, increasing the chances that the supplier of the goods that fills the container may inadvertently fracture the hinge. Furthermore, the thin nature and typically awkward location of the tear strip makes grabbing onto and removing the strip less consumer friendly.

As such, there is a need for new tamper evident packages that address these concerns, as well as methods of increasing prominence of the evidence of tamper with a container, e.g., of consumer goods.

SUMMARY OF THE INVENTION

Accordingly, the present invention is directed to containers and packaging that incorporate novel tamper evident features that make prominent the evidence of tamper. In particular, the novel tamper prominent containers of the present invention comprise newly designed tamper prominent images, i.e., prominent continuity control (PCC) images. Additionally, the present invention provides novel methods of increasing prominence of the evidence of tamper with a container, e.g., of consumer goods, by incorporating prominent continuity control (PCC) images integrated with a button locking assembly that must be removed to open a locked container making prominent the evidence of tamper through clear visualization in the PCC image, e.g., prominently displaying an image of a broken lock after full fracture and removal of the button locking assembly.

As such, one aspect of the invention provides a tamper prominent container comprising: a cover portion comprising a first button lock component of a button locking assembly positioned on a first access tab, and separable from the first access tab by perforations; and a base portion comprising a second button lock component of the button locking assembly on a second access tab, which provides the locking matching pair to said first button lock component, and separable from the second access tab by perforations. The combination of the cover portion and the base portion in the closed position with the button locking assembly in the locked position form a prominent continuity control (PCC) image, and the button locking assembly in the locked position prevents opening of the container. Moreover, the force required to separate the first button lock component from the second button lock component is greater than the force required to fracture the perforations that separate the button lock components from their respective access tabs, such that upon fracture and removal of the button locking assembly the PCC image makes prominent the evidence of tamper.

Another aspect of the invention provides a tamper prominent container comprising: a cover portion comprising a first button lock component of a button locking assembly positioned on a first access tab, and separable from the first access tab by perforations, wherein the first button lock component is a male protrusion button component; and a base portion comprising a second button lock component of the button locking assembly on a second access tab, which provides the locking matching pair to said first button lock component, and separable from the second access tab by perforations, wherein the second button lock component is a female recess button lock component. The combination of the cover portion and the base portion in the closed position with the button locking assembly in the locked position form a prominent continuity control (PCC) image of a lock that appears as a broken lock when the button locking assembly is fractured and removed, and wherein the button locking assembly in the locked position prevents opening of the container. Moreover, the force required to separate the first button lock component from the second button lock component is greater than the force required to fracture the perforations that separate the button lock components from their respective access tabs, such that upon fracture and removal of the button locking assembly the PCC image makes prominent the evidence of tamper on the residual access tabs. Furthermore, the removal of the button locking assembly leaves residual access tabs that are positioned to afford repeated opening (e.g., configured to produce alternating access flaps upon full fracture and removal of the button locking assembly).

An additional aspect of the invention provides a method of increasing prominence of the evidence of tamper with a container comprising the steps of incorporating a prominent continuity control (PCC) image into a container with a button locking assembly according to the tamper prominent containers of the present invention, such that the upon fracture and removal of the button locking assembly of these containers, the PCC image makes prominent the evidence of tamper.

BRIEF DESCRIPTION OF THE FIGURES

Advantages of the present apparatus will be apparent from the following detailed description, which description should be considered in combination with the accompanying figures, which are not intended to limit the scope of the invention in any way.

DETAILED DESCRIPTION OF THE INVENTION

Figure 1:
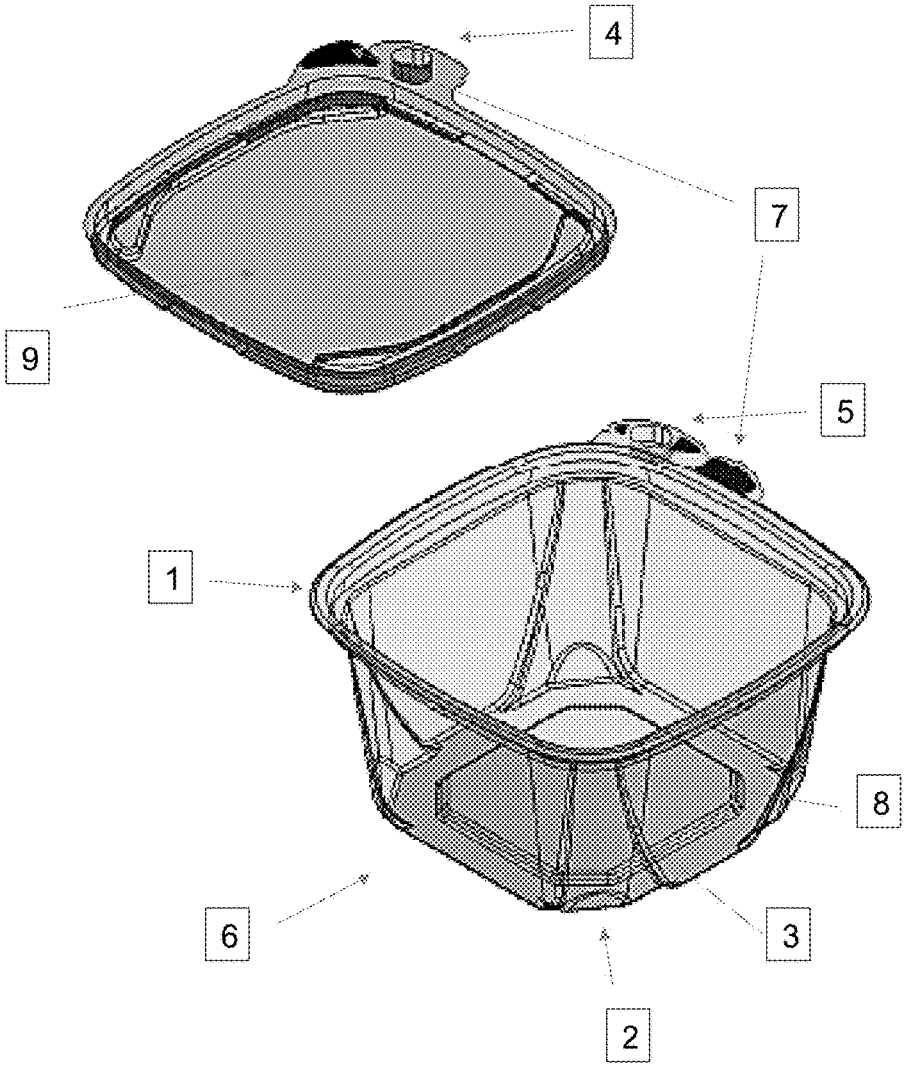
FIG. 1 is a top down perspective view of a containers depicted with the cover portion and base portion separated, but aligned to clearly show the orientation for locking the container using a removable button locking assembly.

The present invention is directed to containers and packaging that incorporate novel tamper evident features that make prominent the evidence of tamper. Such feature affords the user the ability to perceive the tampering of a package without having to relate it to other non-tampered packages based on the prominent, or obvious, evidence of tamper. In particular, the novel tamper prominent containers of the present invention comprise novel tamper prominent images, i.e., prominent continuity control (PCC) images. Additionally, the present invention provides novel methods of increasing prominence of the evidence of tamper with a container, e.g., of consumer goods, by incorporating prominent continuity control (PCC) images integrated with a button locking assembly that must be removed to open a locked container making prominent the evidence of tamper through clear visualization in the PCC image, e.g., prominently displaying an image of a broken lock after full fracture and removal of the button locking assembly.

The present invention, including containers and methods will be described with reference to the following definitions that, for convenience, are set forth below. Unless otherwise specified, the below terms used herein are defined as follows:

I. Definitions

As used herein, the term "a," "an," "the" and similar terms used in the context of the present invention (especially in the context of the claims) are to be construed to cover both the singular and plural unless otherwise indicated herein or clearly contradicted by the context.

The language "closed position" describes the characterization of the container status when the cover portion and the base portion of the container are reversibly interlocked. For example, in certain embodiments, this would occur when the peripheral locking flange assembly and the upper peripheral sealing edge of the base are reversibly interlocked. This language is distinguished from the language "locked position," which is the characterization of the status of the button locking assembly that is the result of the closure of the button locking assembly that may not be reversed without causing the removal of the button locking assembly from the container.

The term "flange" is art-recognized and is used herein to describe a projecting flat rim or collar on an object, serving to strengthen an object's position on a structure upon which it rests, e.g., a lip or a rail structure. In certain embodiments of the containers of the present invention, the flange is part of a "peripheral locking flange assembly" which serves to contribute to the physical locking in place of the cover by interlocking with the upper peripheral sealing edge of the base, i.e., the flange is the outer edge of this assembly. In particular embodiments of the present invention, the flange comprises a truncated recessed flange (TRF).

The term "fracture" is used herein to describe the act of tearing of a frangible score line or perforation. Moreover, the language "full fracture" describes the complete tearing away of the two sides of a frangible score line or perforation.

The term "frangible" is used herein to describe the characteristic of a material that is intended to tear easily and cleanly at the point or line(s) made frangible. For example, a score line or perforation may be made frangible by the relative depth of the score, length, and/or number of the perforation designed or engineered to tear easily and cleanly. Alternatively, such score lines or perforations may be designed to be non-frangible by selecting a relative depth of the score and/or length of the perforation so as to not tear easily and/or cleanly; with an intention to act as something other than a tear point/line. For clarity, non-frangible score lines or perforations, given enough force or effort, may be torn, however are not torn easily, e.g., without a tool, nor cleanly torn, e.g., without producing distortion effects on the edges, in accordance with industry accepted standards of frangible score lines or perforations.

The language "locked position" describes the characterization of the status of the button locking assembly that is the result of the closure of the button locking assembly that may not be reversed without causing the removal of the button locking assembly from the container. In the locked position, the button locking assembly prevents opening of the container, and once in the locked position the tamper prominent containers of the present invention form a prominent continuity control (PCC) image.

The term "imprinting" is art-recognized and is used herein to describe the act of either embossing or debossing a graphic image, e.g., textual, pictorial, or a combination of both. The product of imprinting is an imprint, which is either an embossed or debossed product. Embossing and debossing are techniques used to imprint impressed or depressed images onto material. Embossing produces a raised design, e.g., text or graphic image, which is pressed into material from underneath. Embossing utilizes two dies (a male and female die). In particular embodiments, the imprinting may be printed upon, or the material may be printed upon before imprinting occurs.

The language "prominent continuity control (PCC) image" is used herein to describe an image positioned on a container in such a way, e.g., which when such container is irreversibly opened and/or tampered with, the evidence of tamper alters the continuity of the image in a way that physically changes the image to reflect evidence of tamper upon viewing the image. In the tamper prominent containers of the present invention, the PCC image incorporates a button locking assembly that, when placed in the lock position, opening the container causes the removal of the button locking assembly, which in turn alters the PCC image to make prominent the evidence of tamper.

The term "substantially" is used herein in reference to the degree or extent of the term which it modifies, and that such extent is near but not exactly 100%, and industry accepted standards will assist in defining the quantitative aspects of how "near" 100% is defined. For example, as used in the term "substantially eliminate access," the term "substantially" would indicate that most access by a typical consumer utilizing expected access techniques would be eliminated.

The terms "tamper" or "tampering" are art-recognized and are used herein to describe the altering or adulteration (e.g., unintentional or deliberate) of a product, a package, or container.

The language "tamper evident" is art-recognized and is used herein to describe a container or feature of the container that makes tampering with the container easily detected, e.g., through visual inspection. In certain embodiments, in that such tamper evident features are designed to present difficulty in accessing the contents of the container (i.e., without being detected), the tamper evident containers may be considered tamper resistant.

The language "tamper prominent" is used herein to describe a container or feature of the container that affords the user the ability to perceive the tampering of a package without having to relate it to other non-tampered packages. In this way, tamper prominent containers are a particular category of tamper evident containers in which the evidence of tampering is intended to be made obvious by the inclusion of a prominent continuity control (PCC) image.

The language "truncated recessed flange (TRF) assembly" as used herein, describes the flange located on the outer edge of the peripheral locking flange assembly on the cover portion of certain containers of the present invention comprising a truncated or shortened structure/appearance. Such language is used in contrast to the art-recognized outwardly extending peripheral flange located on the periphery of a cover characterized by its length, which extends outwardly over the lip presented by the base (e.g., and guarded from access by an upwardly projecting bead); as opposed to the flange described herein, which is characterized by having substantially no extending overlap, e.g., no extending overlap, beyond the lip presented by the base. In certain embodiments, this TRF substantially eliminates, e.g., eliminates, access to the peripheral locking flange assembly, to prevent opening of the container without fracturing the button locking assembly.

II. Tamper Prominent Containers of the Invention

The present invention is directed to containers and packaging that incorporate novel tamper prominent features. Such tamper prominent elements are important for, among other things, deterring theft and preventing the loss of product and income for the seller, as well as instilling consumer confidence in the integrity of the contents within the container and confidence in the ability of the seller and/or manufacturer to provide and maintain quality goods.

As such, in one embodiment, the present invention provides a tamper prominent container comprising:

a cover portion comprising a first button lock component of a button locking assembly positioned on a first access tab, and separable from the first access tab, e.g., by perforations;

a base portion comprising a second button lock component of the button locking assembly on a second access tab, which provides the locking matching pair to said first button lock component, and separable from the second access tab, e.g., by perforations;

wherein the combination of the cover portion and the base portion in the closed position with the button locking assembly in the locked position form a prominent continuity control (PCC) image, and wherein the button locking assembly in the locked position prevents opening of the container; and wherein the force required to separate the first button lock component from the second button lock component is greater than the force required to fracture the perforations that separate the button lock components from their respective access tabs, such that upon fracture and removal of the button locking assembly the PCC image makes prominent the evidence of tamper.

Another embodiment of the present invention provides a tamper prominent container comprising:

a cover portion comprising a first button lock component of a button locking assembly positioned on a first access tab, and separable from the first access tab, e.g., by perforations, wherein the first button lock component is a male protrusion button component;

a base portion comprising a second button lock component of the button locking assembly on a second access tab, which provides the locking matching pair to said first button lock component, and separable from the second access tab, e.g., by perforations, wherein the second button lock component is a female recess button lock component;

wherein the combination of the cover portion and the base portion in the closed position with the button locking assembly in the locked position form a prominent continuity control (PCC) image of a lock that appears as a broken lock when the button locking assembly is fractured and removed, and wherein the button locking assembly in the locked position prevents opening of the container; and wherein the force required to separate the first button lock component from the second button lock component is greater than the force required to fracture the perforations that separate the button lock components from their respective access tabs, such that upon fracture and removal of the button locking assembly the PCC image makes prominent the evidence of tamper on the residual access tabs, wherein the removal of the button locking assembly leaves residual access tabs that are positioned to afford repeated opening (e.g., configured to produce alternating access flaps upon full fracture and removal of the button locking assembly).

The tamper prominent containers of the present invention, are not limited by size or shape, i.e., the containers may be any size or shape. In certain embodiments, the shape of the tamper prominent containers of the present invention may be selected from the group consisting of square, rectangle, round, elliptical, triangular, pentagon, hexagon, octagon, oval, quatrefoil, and curvilinear triangle. In certain embodiments, these shapes may be formed by arced lines (as compared with straight lines). In particular embodiments, the lower perimeter of the base portion is formed with straight lines, and the upper perimeter of the base portion (e.g., where the cover portion is placed to interlock with the base portion) is formed with arced lines. In addition, the shapes may contain arced vertices, which creates an arced edge lock at the corners of the shaped container structure, and which improves leak resistance.

In certain embodiments of the present invention, the first button lock component is a male protrusion button component and the second button lock component is a female recess button lock component.

In certain embodiments of the present invention, upon removal of the button locking assembly the prominent continuity control (PCC) image makes prominent the evidence of tamper on the residual access tabs.

In certain embodiments of the present invention, the removal of the button locking assembly leaves residual access tabs that are positioned to afford repeated opening (e.g., for example, configured to produce alternating access tabs upon full fracture and removal of the button locking assembly). These access tabs are created by the residual of the button locking assembly after the button locking assembly has been removed, which produce suitable overlaps or tabs that afford the user repeated access to the contents of the container after the container has been closed and locked, e.g., interlocked. In one particular embodiment, the alternating access tabs comprise one access tab on the base portion and one access tab on the cover portion.

In certain embodiments of the present invention, at least one of the access tabs further comprises additional imprints (e.g., for information or grip).

In certain embodiments of the present invention, at least one of the access flaps is configured with a grip ridge.

In certain embodiments of the present invention, the volume capacity is selected from 2 US fluid ounces to 64 US fluid ounces (e.g., wherein the volume size measurements are based on an industry standard "fill line" in fluid ounces). In certain specific embodiments, the dimensions of the containers range from 0.5 inches by 1.5 inches by 1.5 inches to 6.0 inches by 14.0 inches by 14.0 inches.

In a particular embodiment of the invention, the tamper prominent container is a rectangle shape, e.g., formed with arced lines, with a volume capacity of 12 US fluid ounces. In another particular embodiment of the invention, the tamper prominent container is a rectangle shape, e.g., formed with arced lines, with a volume capacity of 24 US fluid ounces.

In certain embodiments of the present invention, the container is comprised of plastic, e.g., clear/see-through or opaque plastic.

In certain embodiments of the present invention, the tamper prominent container may comprise an imprint in any location or component of the container such that it does not affect the ability of the container to perform its intended function. In particular embodiments, the imprinting may be printed upon, or the material may be printed upon before imprinting occurs.

In certain embodiments of the present invention, the container further comprises printed graphics, e.g., distortion control printed graphics. In particular embodiments, the printed graphics comprise 2 or more colors. In particular embodiments, the printed graphics comprise 3 or more colors. In certain embodiments, the printing may be on the upper surface (product facing) of the container, the lower surface (underside that faces away from the product) of the container, or a combination of both.

In certain embodiments of the present invention, the container comprises an enhanced security locking feature that assists in ensuring structural integrity of the cover portion at one or more sides to prevent the cover from flexing in any manner that would allow access to the contents of the container without removing the button locking assembly. The enhanced security locking feature comprises a male protrusion supporting post centrally located on the inner sidewall of one or more sides of the base portion, e.g., of sufficient size and shape, which is engineered to provide additional support to the cover, and rest within a receiving recess of the cover in the closed position (e.g., adjacent to the peripheral locking flange assembly). In a specific embodiment, the post is a button engineered to reversibly engage and interlock with the cover portion in a recess located on the cover. In particular embodiments, the cover portion recess located internally adjacent to the peripheral locking flange assembly is modified to receive the male protrusion button, e.g., by flattening the recess location.

In particular embodiments, and without being limiting, such enhanced security locking feature may be present on containers that reach a size where pressing the middle of the cover portion can result in sufficient enough corresponding separation between the upper sealing edge and the peripheral locking flange assembly as to afford unauthorized access to the contents of the container without removing the button locking assembly. In a particular embodiment, only one side of the container possess this enhanced security locking feature. In particular embodiments, two or more sides may possess this enhanced security locking feature.

Moreover, in certain embodiments, the tamper prominent containers of the present invention may incorporate additional design elements that do not significantly inhibit or prevent the features of the containers explicitly described herein.

A. Cover Portion

The cover portion of the tamper prominent containers of the present invention comprises a first button lock component of a button locking assembly positioned on a first access tab, and separable from the first access tab by perforations. In certain embodiments of the present invention, the cover portion further comprises a peripheral locking flange assembly. This peripheral locking flange assembly comprises a flange, i.e., the flange is the outer edge of this assembly, and a locking structure that is designed/constructed to reversibly interlock with the upper peripheral sealing edge of the base portion that is engineered with a negative draft angle, or in-cut, extending substantially about the perimeter of the base portion. The circumferential recess created by this negative draft angle matches the shape of the locking structure of the peripheral locking flange assembly to assist in reversibly securing the cover to the base. In certain embodiments, a chamfer edge design of the cover portion peripheral locking flange assembly affords an ease of closing the cover into a secure interlocked position.

In certain embodiments of the present invention, 1) the cover portion further comprises a peripheral locking flange assembly, and 2) the base portion comprises an upper peripheral sealing edge configured to substantially eliminate access to the peripheral locking flange assembly of the cover portion when the container is in the closed position.

In certain embodiments of the present invention, the peripheral locking flange assembly comprises an outwardly extending peripheral flange.

In certain embodiments of the present invention, the peripheral locking flange assembly comprises a truncated recessed flange (TRF).

In certain embodiments of the invention, the cover portion further comprises a stacking ridge configured to allow a second container to be stacked on top of the tamper prominent container.

In certain embodiments of the invention, the cover portion further comprises an optimized surface, e.g., sidewall or top surface, engineered for maximum labeling compatibility.

In certain embodiments of the present invention, the cover portion further comprises printing, e.g., distortion control printed graphics. Distortion control printing, or distortion printing is the process of printing a distorted version of an image onto a sheet of plastic and systematically vacuum forming the sheet on a mold so that specific areas of the printed image appear in intended corresponding areas of the resulting three-dimensional finished product. In particular embodiments, the printed graphics comprise 2 or more colors. In particular embodiments, the printed graphics comprise 3 or more colors. In certain embodiments, the printing may be on the upper surface (product facing) of the container, the lower surface (underside that faces away from the product) of the container, or a combination of both.

In certain embodiments of the invention, the cover portion is comprised of plastic, e.g., clear/see-through or opaque plastic.

B. Base Portion

The base portion of the tamper prominent containers of the present invention serve as the lower portion of the container, i.e., the portion of the container on which the items stored in the container are placed, and with which the cover portion interlocks. The base portion of the containers of the present invention comprise a second button lock component of the button locking assembly on a second access tab, which provides the locking matching pair to said first button lock component, and separable from the second access tab by perforations.

In certain embodiments of the present invention, the base portion comprises an upper peripheral sealing edge configured to substantially eliminate access to the peripheral locking flange of the cover portion when the container is in the closed position. Furthermore, the upper peripheral sealing edge of the base portion may be designed/constructed to reversibly interlock with the peripheral locking flange. The upper peripheral sealing edge of the base portion may be engineered with a negative draft angle, or in-cut, extending substantially about the perimeter of the base portion. The circumferential recess created by this negative draft angle matches the shape of the locking structure of the peripheral locking flange assembly to assist in reversibly securing the cover to the base. In certain embodiments, a chamfer edge design of the upper edge of the peripheral sealing edge affords an ease of closing the cover into a secure interlocked position.

In certain embodiments of the present invention, the base portion shape comprises shapes arced vertices, which create one or more arced edge locks at the corners of the shaped base portion. In particular embodiments, the arced edge lock improves leak resistance when the cover and base portions are interlocked.

In certain embodiments of the invention, the base portion further comprises a return wall engineered to improve structural integrity, e.g., present along the entire outer periphery of the base portion.

In certain embodiments of the invention, the base portion further comprises side ribs, e.g., in the sidewall, engineered to add structural strength and stiffness to the tamper prominent container. An example of this rib structure is shown in FIG. 1.

In certain embodiments of the invention, the base portion further comprises at least one chamfered corner, e.g., at the bottom perimeter of the base portion, engineered to improve material distribution.

In certain embodiments of the invention, the base portion further comprises printing, e.g., distortion control printed graphics. In particular embodiments, the printed graphics comprise 2 or more colors. In particular embodiments, the printed graphics comprise 3 or more colors. In certain embodiments, the printing may be on the upper surface (product facing) of the container, the lower surface (underside that faces away from the product) of the container, or a combination of both.

In certain embodiments of the invention, the base portion is comprised of plastic, e.g., clear/see-through or opaque plastic.

C. Button Locking Assembly

The containers of the present invention comprise a button locking assembly. The button locking assembly comprises matching button lock components on the cover and the base portions such that the container may be placed in a locked position. The cover portion comprises the first button lock component of the button locking assembly, and is positioned on a first access tab, and is separable from the first access tab by perforations. The base portion comprises the second button lock component of the button locking assembly on a second access tab, which provides the locking matching pair to said first button lock component, and is separable from the second access tab by perforations. It is the combination of the cover portion and the base portion in the closed position with the button locking assembly in the locked position that forms a prominent continuity control (PCC) image. Further, the button locking assembly in the locked position prevents opening of the container, wherein the force required to separate the first button lock component from the second button lock component is greater than the force required to fracture the perforations that separate the button lock components from their respective access tabs, such that upon fracture and removal of the button locking assembly the PCC image makes prominent the evidence of tamper by prominently altering the PCC image. As such, in order to open the locked container, the locked button locking assembly is accordingly fractured and removed, i.e., affording access to the contents of the container, e.g., via the access tabs. In certain embodiments, the action of opening the container via the access tabs results in the fracture of the button locking assembly, and subsequent removal thereof, prominently altering the PCC image.

In certain embodiments of the present invention, the prominent continuity control (PCC) image is the image of a lock that appears as a broken lock when the container has been opened by the fracture and removal of the button locking assembly.

In certain embodiments of the present invention, the prominent continuity control (PCC) image is an image of words that make a complete statement when locked.

In certain embodiments of the present invention, the PCC image comprises an imprint.

In certain embodiments of the present invention, the PCC image comprises printing.

III. Methods of the Invention

A. Methods of Preparation

It should be readily understood by the ordinarily skilled artisan in light of the disclosure provided herein that a container constructed in accordance with the present invention can be manufactured in a variety of shapes and sizes, and can be formed from resins or plastic materials such as polyethylene, polypropylene, polyvinyl chloride or polyethyleneterephthalat ("PETE"), as well as other suitable materials or combinations thereof. Moreover, the forming process can also vary to include methods such as thermoforming, injection molding or blow molding. In certain embodiments, the container can be transparent, translucent, or opaque, and may be colored in any instance.

In certain embodiments, and by no means intended to limit the containers of the present invention in terms of design or construction, e.g., material composition, the tamper prominent containers of the present invention are prepared by using standard thermoforming techniques/technology, in conjunction with a mold constructed to produce a tamper prominent container of the present invention.

In general, thermoforming is a manufacturing process where a plastic sheet is heated to a forming-temperature as to be pliable, formed with a mold into a specific shape, and trimmed to create a usable product. The sheet is heated in an oven to a high-enough temperature that it can be stretched into or onto a mold and cooled to a finished shape. In certain embodiments, the process may be automated, for example, by using large production machines to heat and form the plastic sheet, as well as trim the formed parts from the sheet using a continuous process.

In particular embodiments, plastic sheet may be fed from a roll or from an extruder into a set of indexing chains that incorporate pins, or spikes, which pierce the sheet and transport it through an oven for heating to forming-temperature. The heated sheet then moves through another station, i.e., a form station, where, with the application of vacuum, a mold and pressure-box close on the sheet to produce the desired product, e.g., the tamper prominent containers of the present invention. The sheet containing the formed product is then trimmed, e.g., with a die that cuts the product from the remaining sheet web.

In certain embodiments, the molds used in these processes may be comprised of wood, composite, or aluminum.

It should be further understood that part of the thermoform process includes molds that create the score lines or perforations. The ordinarily skilled artisan understand the processes that make these frangible or non-frangible, which are well known in the art.

B. Methods of Increasing Prominence of the Evidence of Tamper

Another embodiment of the present invention provides a method of increasing prominence of the evidence of tamper with a container comprising the steps of incorporating a prominent continuity control (PCC) image into a container with a button locking assembly according to the present invention, such that upon fracture and removal of the button locking assembly of these containers, the PCC image makes prominent the evidence of tamper.

In certain embodiments of the present invention, the prominent continuity control (PCC) image is the image of a lock that appears as a broken lock when the container has been opened by the fracture and removal of the button locking assembly.

In certain embodiments of the present invention, the prominent continuity control (PCC) image is an image of words that make a complete statement when locked.

In certain embodiments of the present invention, the PCC image comprises an imprint.

In certain embodiments of the present invention, the PCC image comprises printing.

In certain embodiments, the imprinting or the printing may be on the upper surface (product facing) of the container, the lower surface (underside that faces away from the product) of the container, or a combination of both.

With respect to the step of "incorporating," such term is used to describe either (1) imprinting or printing on the material, e.g., plastic, before thermoforming through distortion control printed graphics, or (2) obtaining one or more components of the tamper prominent container after thermoforming and imprinting, printing, or spraying the PCC directly onto the plastic.

IV. Design Aspects of the Invention

Independent of the utility related to the containers of the present invention, the ornamental appearance of any novel design provided herein is intended to be part of this invention, for example, each of the perspective views in FIGS. 1 through 5, which may form an independent or combined ornamental appearance of the containers described herein.

Accordingly, one embodiment of the present invention provide an ornamental design for a tamper prominent container as shown and described.

Exemplification

Having thus described the invention in general terms, reference will now be made to the accompanying drawings of exemplary embodiments, which are not necessarily drawn to scale, and which are not intended to be limiting in any way.

In this respect, it is to be understood that the invention is not limited in its application to the details of construction and to the arrangements of the components set forth in the following description or illustrated in the Figures. The invention is capable of other embodiments and of being practiced and carried out in various ways. Also, it is to be understood that the phraseology and terminology employed herein are for the purpose of description and should not be regarded as limiting.

FIG. 1 is a top down perspective view of a container depicted with the cover portion and base portion separated, but aligned to clearly show the orientation for locking the container using a removable button locking assembly. The force required to separate the first button lock component 4 from the second button lock component 5 is greater than the force required to fracture the perforations that separate the button lock components from their respective access tabs. Accordingly, in order to open the container, the button lock components (together forming the button locking assembly) are separated from their respective associated access tabs, i.e., affording access to the contents of the container.

Figure 2:
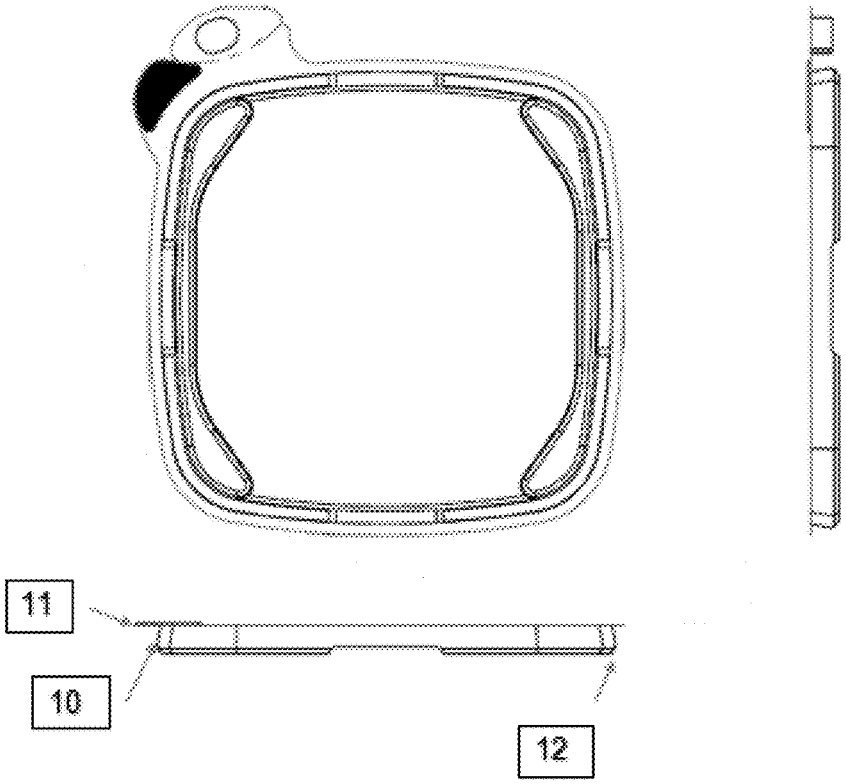
FIG. 2 is a top down perspective view of the cover portion of the container of FIG. 1, shown with expanded side profile views below and to the right. The side dimensions are shown with a ratio of 4.62 to 4.15, and with a corresponding lid height of 0.25.

Return wall 1 shown in this perspective was engineered to improve structural integrity of the container, and is present along the entire outer periphery of the base portion. Chamfered corner 2 was designed to improve overall integrity and allowed for reliable material distribution, and was present in each of the 4 corners of this rectangular container. Ribs 3 were incorporated into the side wall of the container to improve structural integrity, are present as a mirror pair on each side wall of the container. The outer footprint 6 of the container was minimized in size to maximize use of available retail real estate. Gripping patterns were added on the access tabs 7 and afforded a gripping feature and simplified the action of tearing. Access tabs 7 allow the container to be open and closed after the button locking assembly is removed, affording the ability to reuse the container; and are created by the act of removing the button locking assembly. Sidewall 8 is presented as a flat surface design for branding convenience. Branding area 9 was located on the cover portion and is maximized by design to maximize the branding area FIG. 2 is a top down perspective view of the cover portion of the container of FIG. 1, shown with expanded side profile views below and to the right. The first button lock component, a male protrusion button component, is shown on the cover portion. The cover portion shown is designed to allow confident multiple container stacking. Arced edge lock 10 at the corners of the shaped container improves leak resistance. Truncated peripheral locking flange assembly 11 is designed to securely and reversibly interlock with the upper peripheral sealing edge of the base portion; as to ensure container cannot be opened until button locking is removed. Chamfered edge 12 is designed to allow ease of closing the cover portion, i.e., interlocking the cover portion with the base portion.

Figure 3:
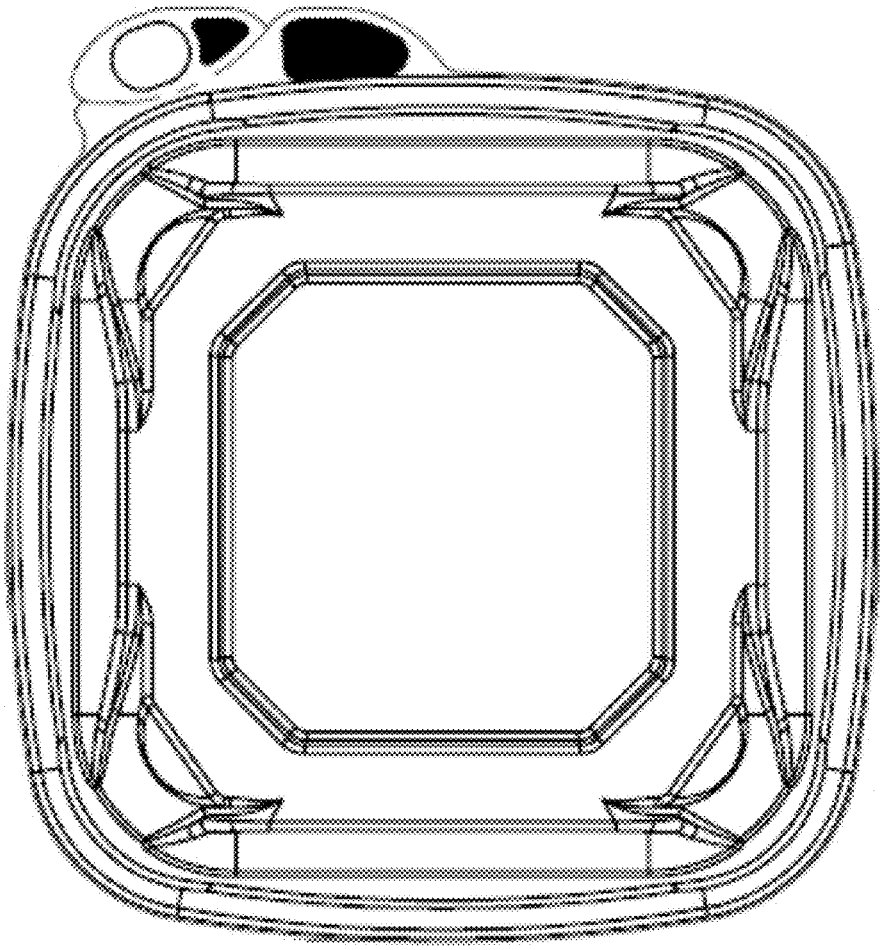
FIG. 3 is a top down perspective view of the base portion of the container of FIG. 1, shown with the cover portion positioned on top of the base portion. The outer dimensions are shown with a ratio of 4.75 to 4.42.

FIG. 3 is a top down perspective view of the base portion of the container of FIG. 1, shown with expanded side profile views below and to the right. The second button lock component, a female recess button lock component, is shown on the base portion.

Figure 4:
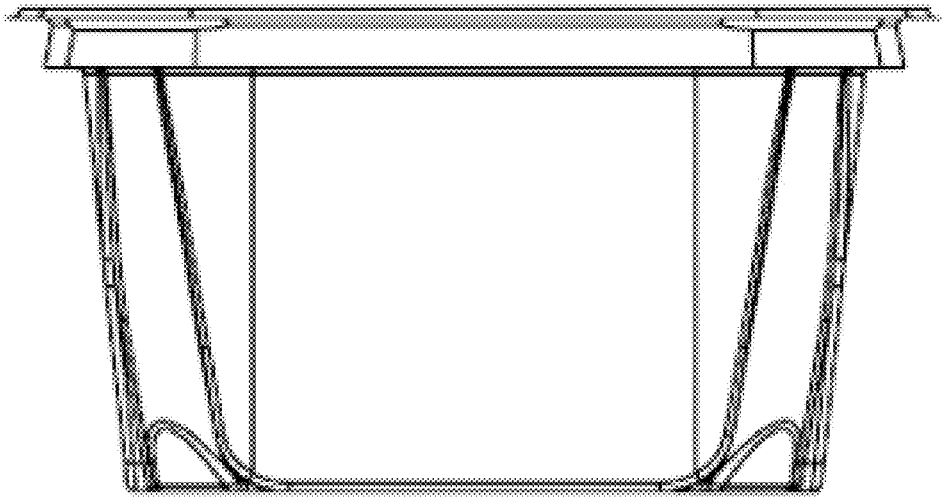
FIG. 4 is a side profile view of the base portion of the container shown in FIG. 3, as viewed from the side opposite to the side with the button lock component. The height of the container with cover portion is shown with a corresponding height of 2.28 (in reference to FIG. 3).

FIG. 4 is a side profile view of the base portion of the container shown in FIG. 3, as viewed from the side opposite to the side with the button lock component.

Figure 5:
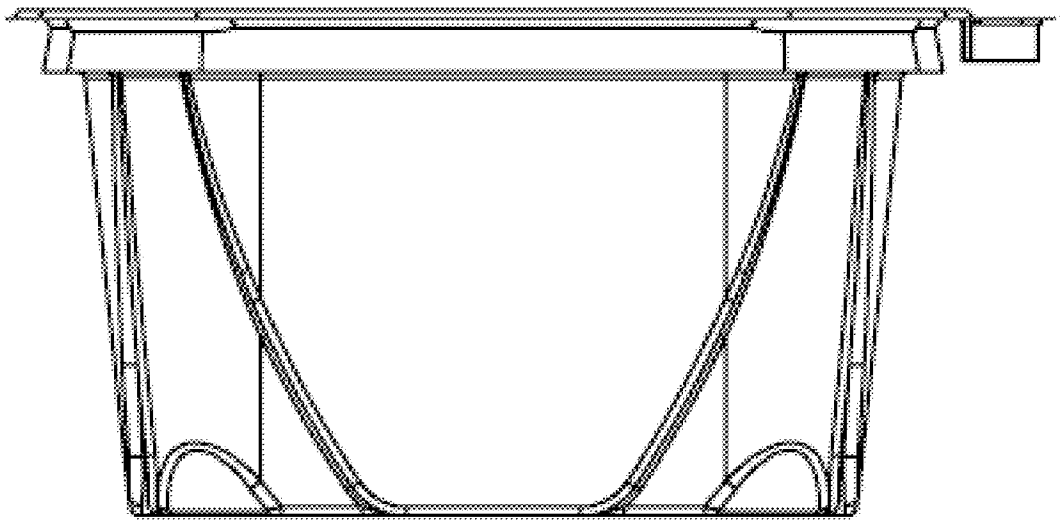
FIG. 5 is a side profile view of the base portion of the container shown in FIG. 3, as viewed from the side adjacent to the side with the button lock component.

FIG. 5 is a side profile view of the base portion of the container shown in FIG. 3, as viewed from the side adjacent to the side with the button lock component. The second button lock component, a female recess button lock component, is shown on the base portion.

INCORPORATION BY REFERENCE

The entire contents of all patents, published patent applications and other references cited herein are hereby expressly incorporated herein in their entireties by reference.

EQUIVALENTS

Those skilled in the art will recognize, or be able to ascertain using no more than routine experimentation, numerous equivalents to the specific procedures described herein. Such equivalents were considered to be within the scope of this invention and are covered by the following claims. Moreover, any numerical or alphabetical ranges provided herein are intended to include both the upper and lower value of those ranges. In addition, any listing or grouping is intended, at least in one embodiment, to represent a shorthand or convenient manner of listing independent embodiments; as such, each member of the list should be considered a separate embodiment.

What is claimed is:

1. A tamper prominent container comprising:

a cover portion comprising a first button lock component of a button locking assembly positioned on a first access tab, and separable from the first access tab by perforations;

a base portion comprising a second button lock component of the button locking assembly on a second access tab, which provides the locking matching pair to said first button lock component, and separable from the second access tab by perforations;

wherein the combination of the cover portion and the base portion in the closed position with the button locking assembly in the locked position form a prominent continuity control (PCC) image, and wherein the button locking assembly in the locked position prevents opening of the container; and wherein the force required to separate the first button lock component from the second button lock component is greater than the force required to fracture the perforations that separate the button lock components from their respective access tabs, such that upon fracture and removal of the button locking assembly the PCC image makes prominent the evidence of tamper.

2. The tamper prominent container of claim 1, wherein the first button lock component is a male protrusion button component and the second button lock component is a female recess button lock component.

3. The tamper prominent container of claim 1, wherein upon removal of the button locking assembly the prominent continuity control (PCC) image makes prominent the evidence of tamper on the residual access tabs.

4. The tamper prominent container of claim 1, wherein the removal of the button locking assembly leaves residual access tabs that are positioned to afford repeated opening.

5. The tamper prominent container of claim 1, wherein the prominent continuity control (PCC) image is the image of a lock that appears as a broken lock when the container has been opened by the fracture and removal of the button locking assembly.

6. The tamper prominent container of claim 1, wherein the prominent continuity control (PCC) image is an image of words that make a complete statement when locked.

7. The tamper prominent container of claim 1, wherein 1) the cover portion further comprises a peripheral locking flange assembly, and 2) the base portion comprises an upper peripheral sealing edge configured to substantially eliminate access to the peripheral locking flange assembly of the cover portion when the container is in the closed position.

8. The tamper prominent container of claim 7, wherein the peripheral locking flange assembly comprises an outwardly extending peripheral flange.

9. The tamper prominent container of claim 7, wherein the peripheral locking flange assembly comprises a truncated recessed flange (TRF).

10. The tamper prominent container of claim 1, wherein the PCC image comprises an imprint.

11. The tamper prominent container of claim 1, wherein at least one of the access tabs further comprises additional imprints.

12. The tamper prominent container of claim 11, wherein at least one of the access tabs is configured with a grip ridge.

13. The tamper prominent container of claim 1, wherein the base portion further comprises a return wall engineered to improve structural integrity.

14. The tamper prominent container of claim 1, wherein the base portion further comprises side ribs engineered to add structural strength and stiffness to the tamper prominent container.

15. The tamper prominent container of claim 1, wherein the shape of the container is selected from the group consisting of square, rectangle, round, elliptical, triangular, pentagon, hexagon, octagon, oval, quatrefoil, and curvilinear triangle.

16. The tamper prominent container of claim 1, wherein the tamper prominent container is comprised of plastic.

17. The tamper prominent container of claim 1, wherein the cover portion further comprises distortion control printed graphics.

18. The tamper prominent container of claim 1, wherein the base portion further comprises distortion control printed graphics.

19. A tamper prominent container comprising:

a cover portion comprising a first button lock component of a button locking assembly positioned on a first access tab, and separable from the first access tab by perforations, wherein the first button lock component is a male protrusion button component;

a base portion comprising a second button lock component of the button locking assembly on a second access tab, which provides the locking matching pair to said first button lock component, and separable from the second access tab by perforations, wherein the second button lock component is a female recess button lock component;

wherein the combination of the cover portion and the base portion in the closed position with the button locking assembly in the locked position form a prominent continuity control (PCC) image of a lock that appears as a broken lock when the button locking assembly is fractured and removed, and wherein the button locking assembly in the locked position prevents opening of the container; and wherein the force required to separate the first button lock component from the second button lock component is greater than the force required to fracture the perforations that separate the button lock components from their respective access tabs, such that upon fracture and removal of the button locking assembly the PCC image makes prominent the evidence of tamper on the residual access tabs, wherein the removal of the button locking assembly leaves residual access tabs that are positioned to afford repeated opening.

20. A method of increasing prominence of the evidence of tamper with a container comprising the steps of incorporating a prominent continuity control (PCC) image into a container with a button locking assembly according to claim 1, such that upon fracture and removal of the button locking assembly of these containers, the PCC image makes prominent the evidence of tamper.

* * * * *